US008092185B2

(12) United States Patent
Hwang et al.

(10) Patent No.: US 8,092,185 B2
(45) Date of Patent: Jan. 10, 2012

(54) IMPELLER AND COOLING FAN INCORPORATING THE SAME

(75) Inventors: Ching-Bai Hwang, Taipei Hsien (TW); Zhi-Hui Zhao, Shenzhen (CN); Ran Lin, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 931 days.

(21) Appl. No.: 12/107,783

(22) Filed: Apr. 23, 2008

(65) Prior Publication Data

US 2009/0196754 A1 Aug. 6, 2009

(30) Foreign Application Priority Data

Feb. 1, 2008 (CN) ..... 2008 1 0066030

(51) Int. Cl.
*F01D 5/14* (2006.01)

(52) U.S. Cl. ..... 416/223 R; 416/228; 416/235; 416/236 R; 415/203

(58) Field of Classification Search ..... 416/179, 416/223 B, 228, 235, 236 R; 415/203
See application file for complete search history.

(56) References Cited

U.S. PATENT DOCUMENTS

| | | | | | |
|---|---|---|---|---|---|
| 1,864,803 | A * | 6/1932 | Clark | 416/236 R |
| D131,271 | S * | 2/1942 | Collura | D23/413 |
| 4,441,857 | A * | 4/1984 | Jackson et al. | 415/206 |
| 4,859,150 | A * | 8/1989 | Takigawa | 416/223 R |
| 6,296,446 | B1 * | 10/2001 | Ishijima et al. | 416/236 A |
| 7,494,325 | B2 * | 2/2009 | Gustafson et al. | 416/236 R |
| 2005/0147498 | A1 * | 7/2005 | Chien et al. | 416/236 R |
| 2007/0134097 | A1 * | 6/2007 | Tanahashi | 416/179 |
| 2009/0067991 | A1 * | 3/2009 | Hwang et al. | 415/119 |

FOREIGN PATENT DOCUMENTS

| | | | |
|---|---|---|---|
| CN | 2367811 | Y | 3/2000 |
| CN | 2709688 | Y | 7/2005 |
| CN | 1884846 | A | 12/2006 |

* cited by examiner

*Primary Examiner* — Igor Kershteyn
(74) *Attorney, Agent, or Firm* — Altis Law Group, Inc.

(57) ABSTRACT

A cooling fan (10) includes a bottom plate (12) a top cover (14) covering the bottom plate, a sidewall (13) disposed between the bottom plate and the top cover, and an impeller (16) enclosed in a space formed between the bottom plate, the top cover and the sidewall. The impeller includes a hub (162), and a plurality of blades (164) radially and outwardly extending from the hub. Each of the blades includes a windward surface (164*a*) and a leeward surface (164*b*) opposite to the windward surface. The leeward surface of each blade defines three indents (171, 172, 173) therein. Two protrusions (174) are formed between adjacent indents. The uneven leeward surface is provided for lowering the noise level generated by the cooling fan during an operation thereof.

15 Claims, 6 Drawing Sheets

IMPELLER AND COOLING FAN INCORPORATING THE SAME

BACKGROUND

1. Technical Field

The present invention relates to cooling fans, and more particularly to an impeller of a cooling fan which helps to decrease noise generated by the cooling fan when the cooling fan is operated.

2. Description of Related Art

It is well known that heat is produced by electronic components such as central processing units (CPUs) during their normal operations. If the heat is not timely removed, these electronic components may overheat. Therefore, heat sinks and cooling fans are often used to cool these electronic components.

Generally, a cooling fan includes an enclosure, a stator received in the enclosure and an impeller being rotatable with respect to the stator. The impeller includes a hub and a plurality of blades radially and outwardly extending from the hub. When the cooling fan operates, the blades of the impeller rotate around the stator to drive an airflow to flow towards an electronic component, thus cooling the electronic component continuously. Increasing revolving speed of the impeller relatively increases the amount of the airflow, and therefore a heat dissipation efficiency of the cooling fan is relatively improved. However, increasing the revolving speed may correspondingly cause a rise of a noise level generated by the cooling fan, thus making a user near the cooling fan feel uncomfortable.

When a flow field of the cooling fan is simulated by a computational fluid dynamics software, it is found that one of the reasons for increase of the noise is a superposition of a plurality of high harmonic waves in a chamber defined between every two adjacent blades of the impeller. What is needed, therefore, is an impeller and a cooling fan incorporating the impeller which has a low operating noise.

SUMMARY

The present invention provides an impeller and a cooling fan incorporating the impeller. The cooling fan in accordance with an embodiment of the present invention includes a bottom housing, a top cover covering the bottom housing, a sidewall disposed between the bottom housing and the top cover, and an impeller enclosed in a space formed between the bottom housing, the top cover and the sidewall. The impeller includes a hub, and a plurality of blades radially and outwardly extending from the hub. Each of the blades includes a windward surface and a leeward surface opposite to the windward surface. The leeward surface of each blade defines three indents therein. Two protrusions are formed between adjacent indents. The uneven leeward surface is provided for lowering the noise level generated by the cooling fan during an operation thereof.

Other advantages and novel features of the present impeller and cooling fan will become more apparent from the following detailed description of preferred embodiments when taken in conjunction with the accompanying drawings.

DETAILED DESCRIPTION

Figure 1:
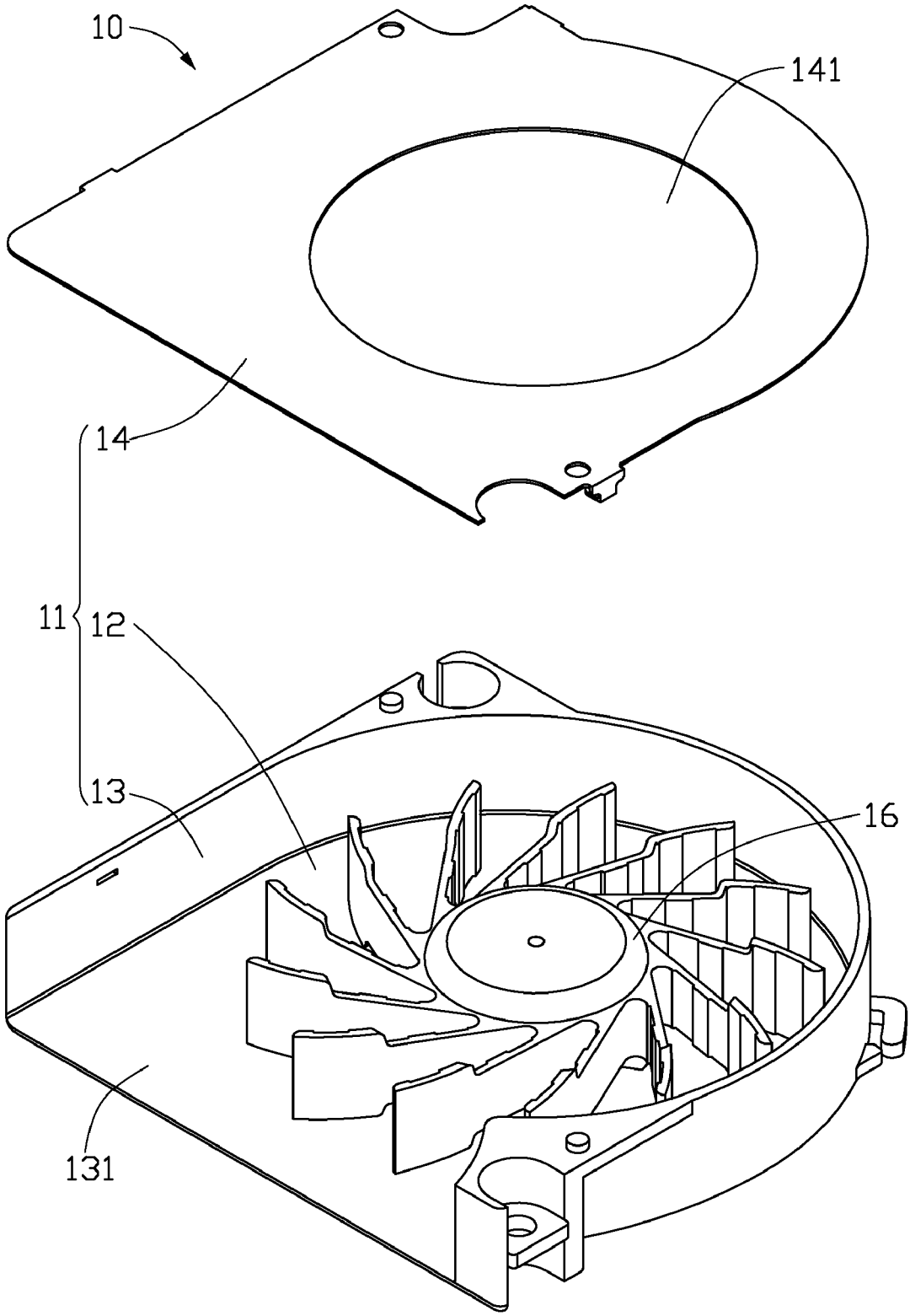
FIG. 1 is an exploded, isometric view of a cooling fan in accordance with a first embodiment of the present invention.

Referring to FIG. 1, a cooling fan 10 in accordance with a first embodiment of the present invention is shown. The cooling fan 10 includes an enclosure 11, a stator (not shown) and an impeller 16 received in the enclosure 11.

The enclosure 11 includes a bottom plate 12, a top cover 14 covering the bottom plate 12, and a sidewall 13 connected between the bottom plate 12 and the top cover 14. The sidewall 13 is integrally formed with the bottom plate 12 from a single piece. The impeller 16 is received in a space formed between the bottom plate 12, the top cover 14 and the sidewall 13. Two air inlets 141 are defined in middle portions of the top cover 14 and the bottom plate 12, respectively. In FIG. 1, only the air inlet 141 in the top cover 14 is shown. An air outlet 131 is defined in the sidewall 13 and perpendicular to the air inlets 141.

Figure 2:
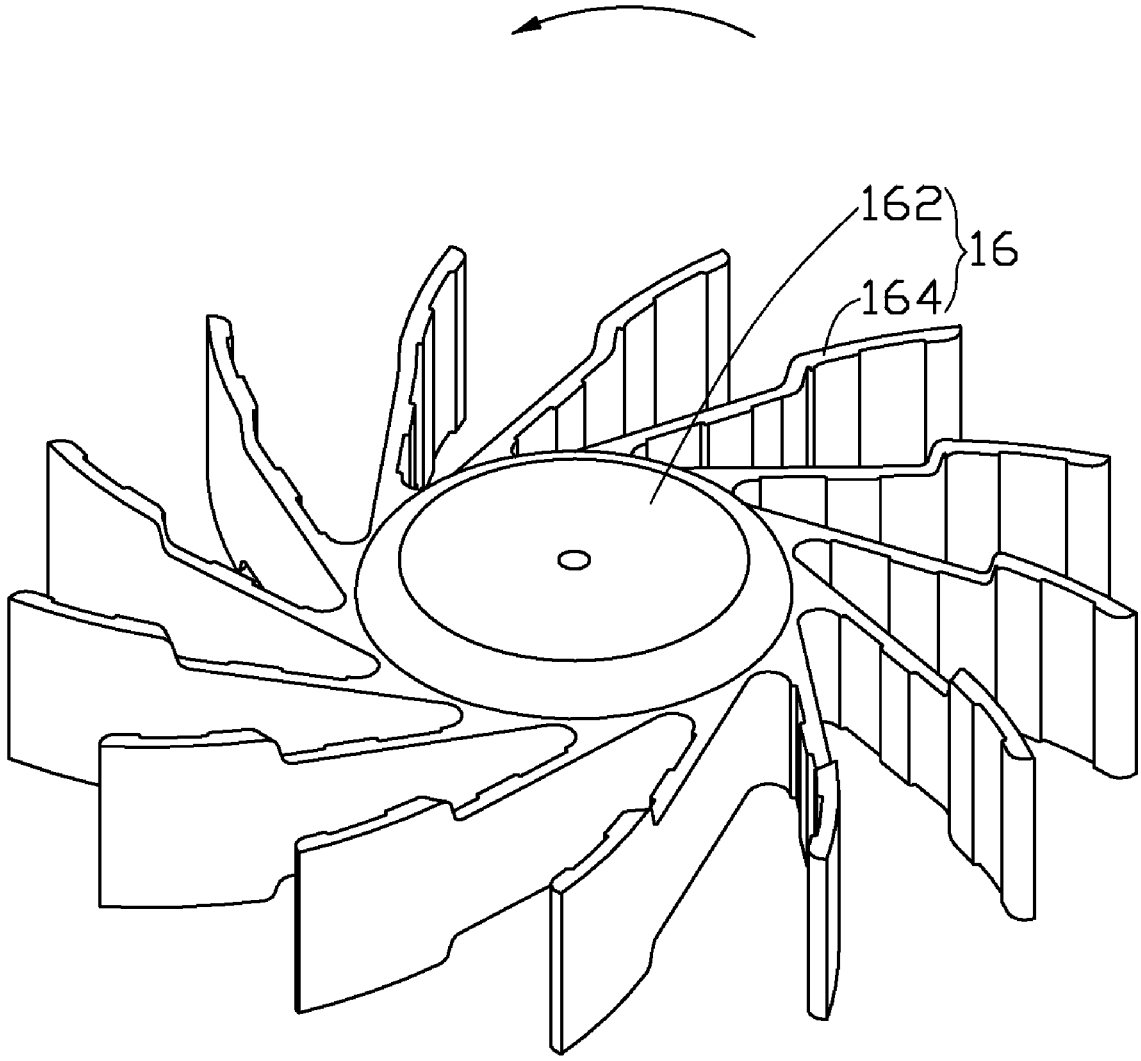
FIG. 2 is an isometric view of an impeller of the cooling fan of FIG. 1.
Figure 3:
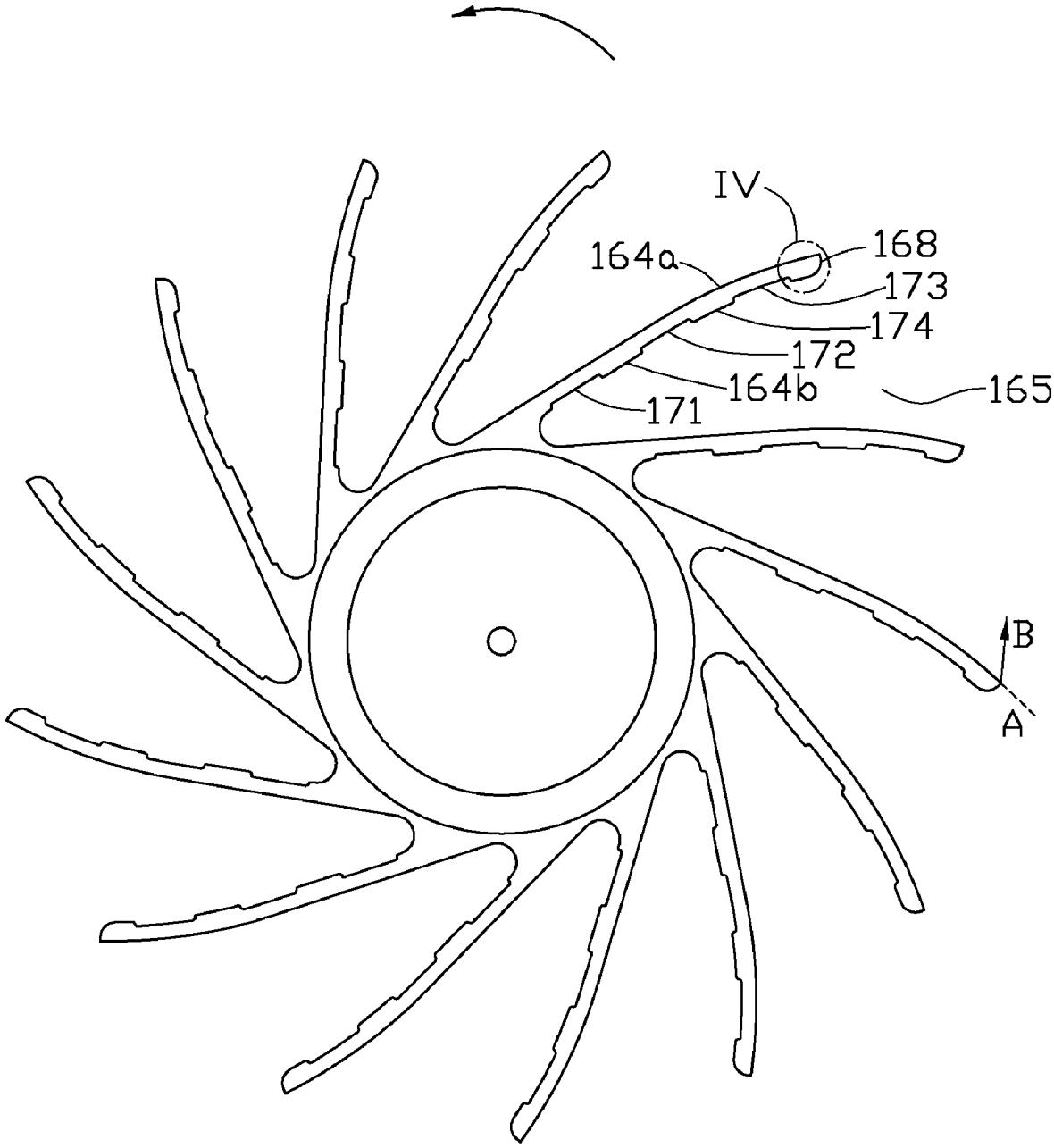
FIG. 3 is a top plan view of the impeller of FIG. 2.

Referring to FIGS. 2 and 3, the impeller 16 includes a hub 162, and a plurality of blades 164 radially and outwardly extending from the hub 162. In operation of the cooling fan 10, the impeller 16 rotates along a counterclockwise direction and drives an airflow entering into the enclosure 11 via the air inlets 141 and leaving the enclosure 11 via the air outlet 131.

Figure 4:
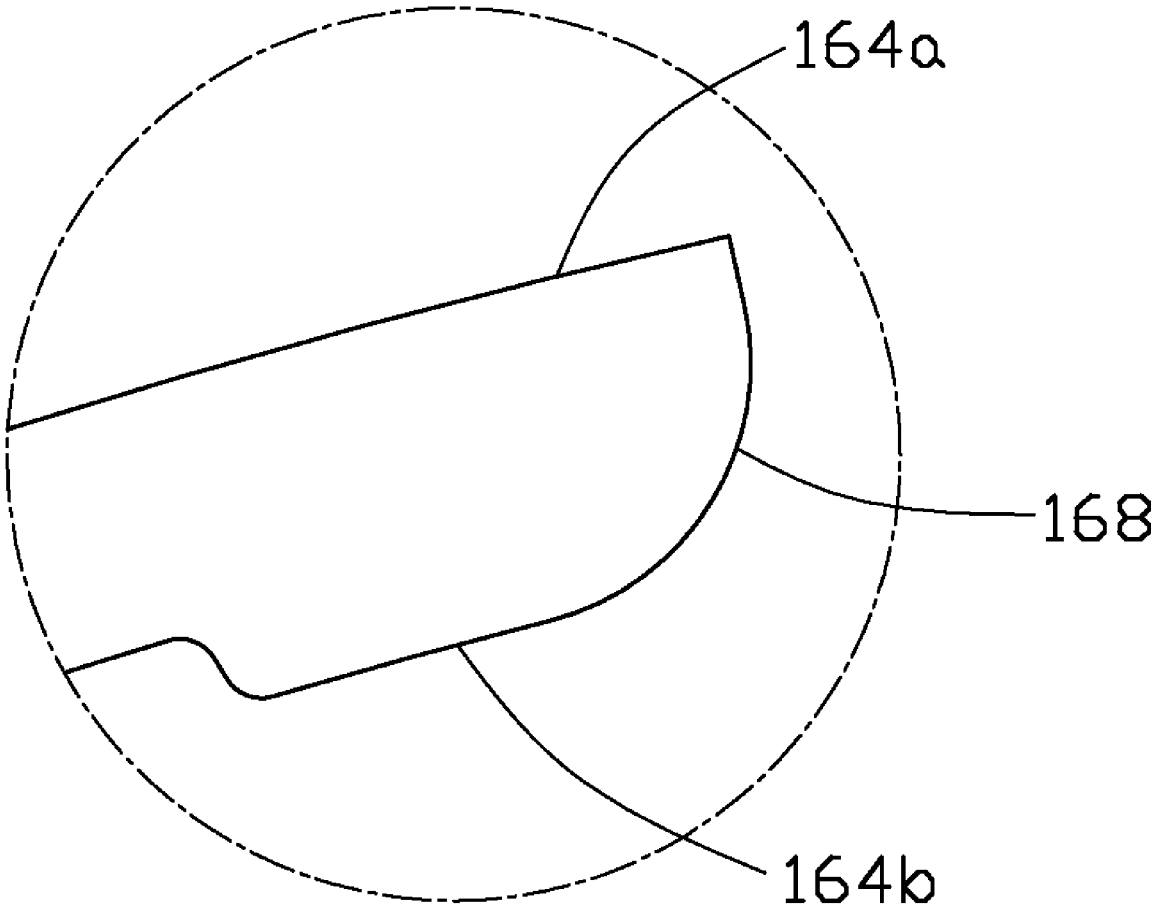
FIG. 4 is an enlarged view of a circled portion IV of the impeller of FIG. 3.

The blades 164 of the impeller 16 are backward-type blades 164. That is, windward and leeward surfaces 164*a*, 164*b* of a front blade 164 both have tip ends slightly and backwardly bent toward a rear blade 164. An extension direction A of the windward surface 164*a* and an extension direction of the leeward surface 164*b* of the blade 164 each form an obtuse angle with a tangent B of a rotation direction of the impeller 16. Referring to FIG. 4, an arc-shaped guiding surface 168 is formed between the tip ends of the windward and the leeward surfaces 164*a*, 164*b* of the blade 164, for smoothly guiding airflow from the windward surface 164*a* toward a chamber 165 defined between the front blade 164 and the rear blade 164. The arc-shaped guiding surface 168 is extended rearwards and inwardly from the tip end of the windward surface 164*a* toward the tip end of the leeward surface 164*b*. As compared to a related backward-type blade with no guiding surface formed between the windward and the leeward surfaces, the guiding surface 168 of the present blade 164 guides the airflow more smoothly toward the chamber 165 defined between the front and the rear blades 164 without decreasing the amount of airflow impelled by the blade 164. Accordingly, a noise level generated during operation of the cooling fan 10 in accordance with the present invention can be lowered.

In this embodiment, the guiding surface 168 has an arc-shaped configuration. Alternatively, the guiding surface 168 may be a slantwise planar surface slanting from the windward surface 164*a* toward the leeward surface 164*b*. The slantwise guiding surface 168 forms an acute angle with the tip end of the windward surface 164*a* of the blade 164. In this embodiment, the guiding surface 168 is formed between the tip ends of the windward and the leeward surfaces 164*a*, 164*b* of the blade 164.

The leeward surface 164*b* of each blade 164 is an uneven surface which defines therein three indents, i.e., a first, a second and a third indents 171, 172, 173 in sequence along a radial direction of the blade 164. The indents 171, 172, 173 of the blade 164 have similar configurations with each other. Each of the indents 171, 172, 173 is rectangular in profile and extends through the leeward surface 164*b* of the blade 164 along an axial direction of the impeller 16. The indents 171, 172, 173 of the blade 164 are evenly distributed on the leeward surface 164*b* and equidistantly spaced from each other along the radial direction of the blade 164. The first indent 171 is defined at a position adjacent to the hub 162 of the blade 164, the third indent 173 is defined at a position adjacent to the tip end of the blade 164, and the second indent 172 is defined between the first and the third indents 171, 173. Two protrusions 174 are defined between adjacent indents, i.e., the first and the second indents 171, 172, and the second and the third indents 172, 173. A distance between the first and the second indents 171, 172 is substantially equal to a distance between the second and the third indents 172, 173.

In rotation of the cooling fan 10, the uneven leeward surfaces 164*b* of the blades 164 break down the superposition of high harmonic waves in the chambers 165, thereby decreasing the noise level generated during the operation of the cooling fan 10. Furthermore, the first, the second and the third indents 171, 172, 173 break down a growth of a laminar flow layer which is formed at the leeward surface 164*b* of the blade 164 during the operation of the cooling fan 10, thereby preventing vortexes from being generated in the chamber 165 during the operation of the cooling fan 10. Thus, the noise level generated during the operation of the cooling fan 10 can be further decreased.

In the present cooling fan 10, the indents 171, 172, 173 of the blade 164 are rectangular in profile. Alternatively, the indents 171, 172, 173 may have other shapes as viewed from a rear thereof, such as trapezium-shaped, or arc-shaped. When the indents 171, 172, 173 are trapezium in profile, a width of each indent 171, 172, 173 gradually increases or decreases from a top of the blade 164 toward a bottom of the blade 164.

Figure 5:
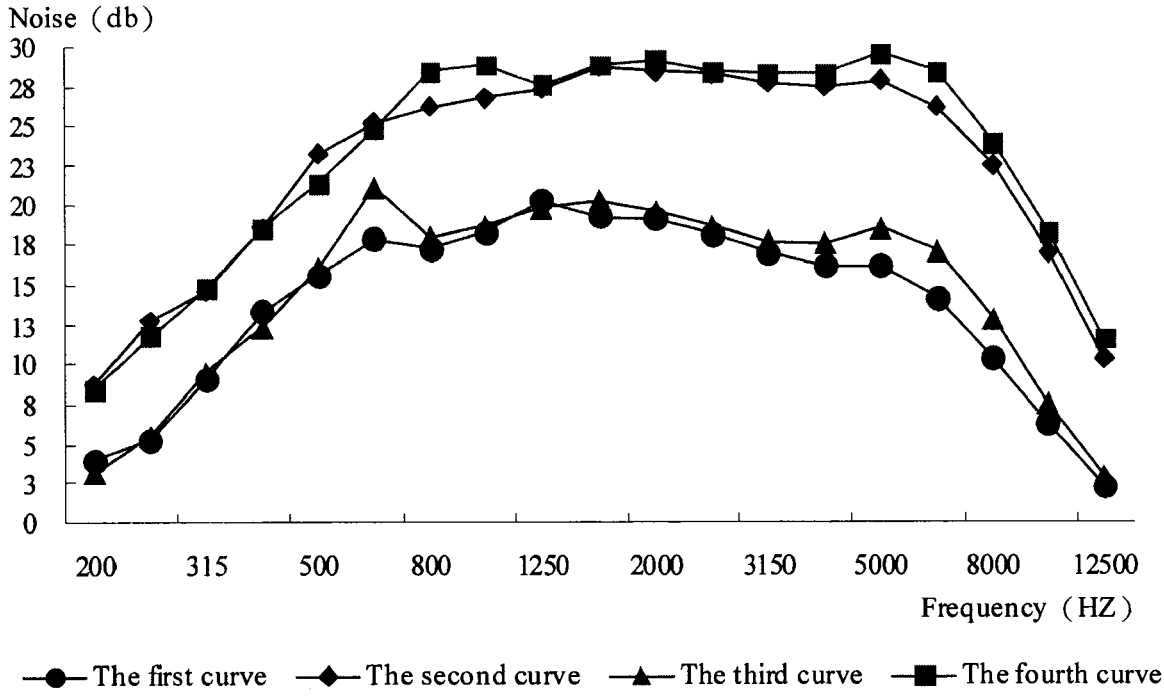
FIG. 5 shows noise-frequency curves of the present cooling fan and a related cooling fan.

Referring to FIG. 5, noise-frequency curves of the present cooling fan 10 and a related cooling fan are shown. The related cooling fan has similar configuration with the present cooling fan 10, but does not include the guiding surface formed between the tip ends of the windward and the leeward surfaces and dose not include the first, the second and the third indents 171, 172, 173 defined in the leeward surface 164*b* of each blade 164. The first and the third curves are respectively obtained when the present and the related cooling fans rotate under a speed of 3000 rotation per minute (rpm). The second and the fourth curves are respectively obtained when the present and the related cooling fans rotate at a speed of 4000 rotation per minute (rpm). FIG. 5 shows that the noise generated by the present cooling fan 10 is smaller than the noise generated by the related cooling fan when the present cooling fan 10 and the related cooling fan rotate under a same speed.

Referring to Table 1, parameters of the present cooling fan 10 and the related cooling fan are shown. Table 1 shows a conclusion that, when the present cooling fan 10 and the related cooling fan rotate under a same speed, the noise generated by the present cooling fan 10 is decreased without substantially decreasing its air pressure and volumetric flow rate.

TABLE 1

| | Rotation speed (rpm) | Noise (dB) | Air pressure (millimeter water column) | Volumetric flow rate (cubic feet per minute) |
|---|---|---|---|---|
| The related cooling fan | 3000 | 29.9 | 3.98 | 4.83 |
| | 4000 | 39.1 | 7.08 | 6.44 |
| The present cooling fan 10 | 3000 | 28.9 | 4 | 4.79 |
| | 4000 | 38.2 | 7.11 | 6.39 |

Figure 6:
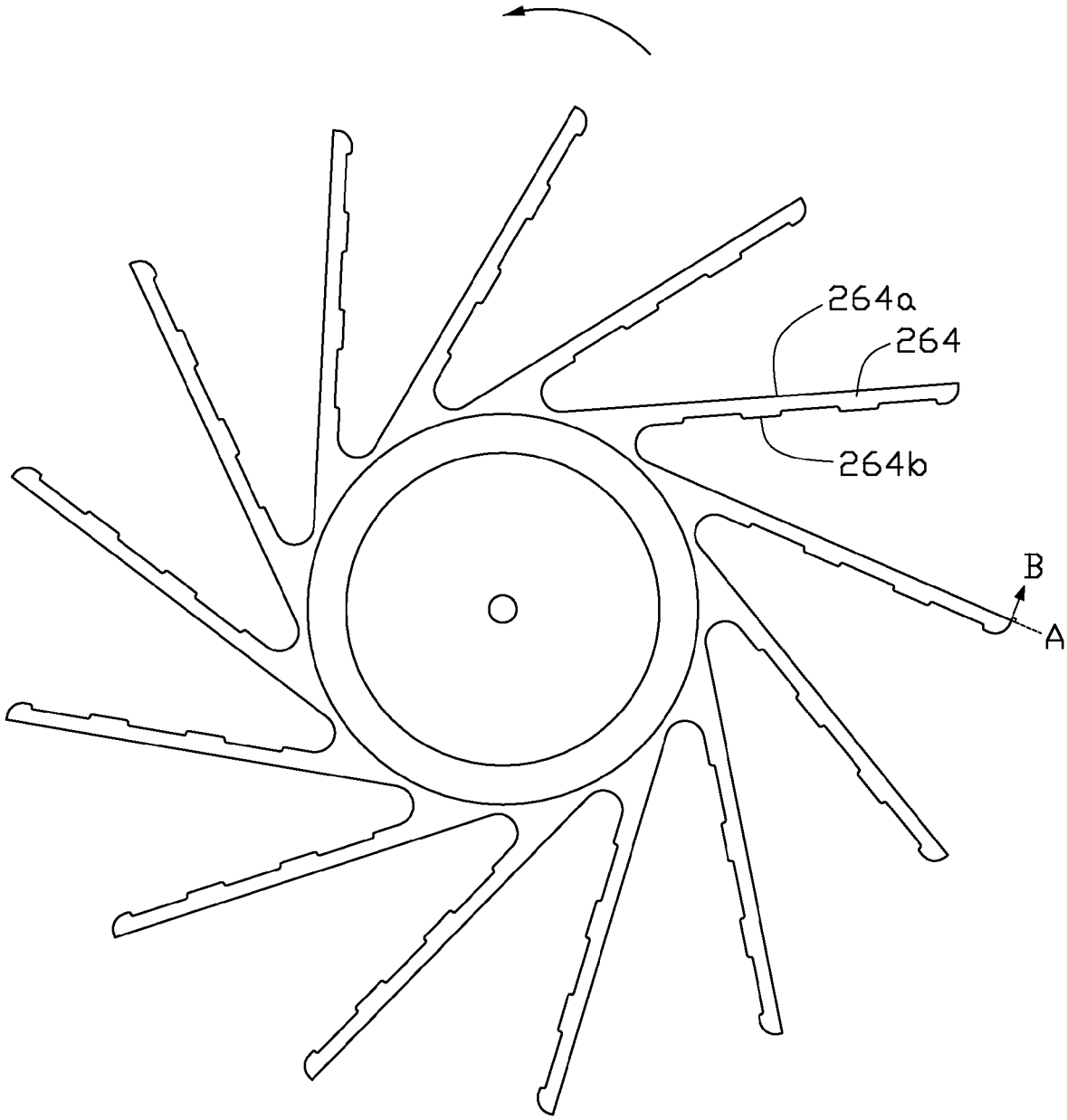
FIG. 6 is a top plan view of a cooling fan in accordance with a second embodiment of the present invention.

Referring to FIG. 6, a second embodiment of an impeller of the present cooling fan 10 is shown. The difference between the second embodiment and the first embodiment is: the blade 264 of the impeller of the second embodiment is a planar-type blade 264 whose windward and leeward surfaces 264*a*, 264*b* are straight linearly shaped as viewed from a top thereof. An extension direction A of a tip end of the windward surface 264*a* and an extension direction of a tip end of the leeward surface 264*b* each form a right angle with the tangent B of the rotation direction of the impeller. Alternatively, the blade 164 of the impeller 16 may be a forward-type blade. That is, windward and leeward surfaces of a rear blade both have tip ends slightly and forwardly bent toward a front blade. Extension directions of the windward and the leeward surfaces of the blade each form an acute angle with the tangent of the rotation direction of the impeller.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An impeller comprising:

a hub; and a plurality of blades radially and outwardly extending from the hub, each of the plurality of blades comprising a windward surface and a leeward surface opposite to the windward surface, the leeward surface defining a plurality of indents therein, a plurality of protrusions being formed between adjacent indents;

wherein a guiding surface is formed between tip portions of the windward and the leeward surfaces, for smoothly guiding airflow from the windward surface toward a chamber defined between two adjacent blades.

2. The impeller as claimed in claim 1, wherein the indents extend through the leeward surface of the blade along an axial direction of the impeller.

3. The impeller as claimed in claim 1, wherein the indents are evenly distributed on the leeward surface along a radial direction of the blade.

4. The impeller as claimed in claim 1, wherein a configuration of the indent is selected from a group consisting of rectangular shaped, trapezium shaped and arc-shaped.

5. The impeller as claimed in claim 1, wherein a configuration of the guiding surface is selected from a group consisting of arc-shaped and slantwise planar shaped.

6. The impeller as claimed in claim 1, wherein the blade is selected from a group consisting of a backward-type blade, a planar-type blade and a forward-type blade.

7. A cooling fan comprising:

a bottom plate;

a top cover covering the bottom plate;

a sidewall disposed between the bottom plate and the top cover; and an impeller enclosed in a space formed between the bottom plate, the top cover and the sidewall, the impeller comprising:

a hub; and a plurality of blades radially and outwardly extending from the hub, each of the plurality of blades comprising a windward surface and a leeward surface opposite to the windward surface, the leeward surface defining a plurality of indents therein, a plurality of protrusions being formed between adjacent indents;

wherein each of the blades is selected from a group consisting of a backward-type blade, a planar-type blade and a forward-type blade.

8. The cooling fan as claimed in claim 7, wherein the indents extend through the leeward surface of the blade along an axial direction of the impeller.

9. The cooling fan as claimed in claim 7, wherein the indents are evenly distributed on the leeward surface along a radial direction of the blade.

10. The cooling fan as claimed in claim 7, wherein a configuration of the indent is selected from a group consisting of rectangular shaped, trapezium shaped and arc-shaped.

11. The cooling fan as claimed in claim 7, wherein a guiding surface is formed between tip portions of the windward and the leeward surfaces, for smoothly guiding airflow from the windward surface toward a chamber defined between two adjacent blades.

12. The cooling fan as claimed in claim 11, wherein a configuration of the guiding surface is selected from a group consisting of arc-shaped and slantwise planar shaped.

13. An impeller for a cooling fan, comprising:

a hub; and a plurality of blades extending radially and outwardly from the hub, each blade having opposite windward and leeward surfaces, wherein the windward surface is an even surface while the leeward surface is an uneven surface, and a guiding surface is extended rearwards and inwardly from a free end of the windward surface toward a free end of the leeward surface.

14. The impeller as claimed in claim 13, wherein the leeward surface is formed with a plurality of separate indents therein.

15. The impeller as claimed in claim 13, wherein the guiding surface has an arced shape.

* * * * *